US009795218B2

(12) United States Patent
Muraguchi et al.

(10) Patent No.: US 9,795,218 B2
(45) Date of Patent: Oct. 24, 2017

(54) CUSHION FOR CHAIR AND CHAIR

(71) Applicant: P.A.S. Corporation, Osaka (JP)

(72) Inventors: Kenichi Muraguchi, Osaka (JP); Hisako Nomura, Osaka (JP)

(73) Assignee: P.A.S. Corporation, Osaka (JP)

( * ) Notice: Subject to any disclaimer, the term of this patent is extended or adjusted under 35 U.S.C. 154(b) by 0 days.

(21) Appl. No.: 14/096,399

(22) Filed: Dec. 4, 2013

(65) Prior Publication Data

US 2015/0150379 A1 Jun. 4, 2015

(51) Int. Cl.
*A47C 7/02* (2006.01)
*A47C 7/40* (2006.01)

(52) U.S. Cl.
CPC ..... *A47C 7/022* (2013.01); *A47C 7/40* (2013.01)

(58) Field of Classification Search
CPC .. A47C 7/18; A47C 7/30; A47C 7/022; A47C 7/40; B60N 2/449
USPC ..... 297/452.16, 452.52, 452.23, 452.21, 297/452.33, 452.34, 452.35
See application file for complete search history.

(56) References Cited

U.S. PATENT DOCUMENTS 1,716,871 A 6/1929 Weldon
D142,800 S * 11/1945 Watson ..... D6/375
D181,975 S * 1/1958 Hail et al. ..... D6/339
2,847,061 A 8/1958 Morton
3,740,096 A * 6/1973 Bridger ..... A47C 7/022 297/452.25
3,749,442 A 7/1973 Berg et al.
4,367,897 A * 1/1983 Cousins ..... 297/284.3
4,484,778 A * 11/1984 Cousins et al. ..... 297/284.3
5,048,894 A * 9/1991 Miyajima et al. ..... 297/452.11
6,102,481 A * 8/2000 Tateyama ..... 297/452.35
6,139,109 A * 10/2000 Lajoie ..... 297/452.28
6,315,363 B1 * 11/2001 Frear ..... 297/452.12
6,550,858 B1 * 4/2003 Grohs et al. ..... 297/216.1
(Continued)

FOREIGN PATENT DOCUMENTS

CN 2837144 Y 11/2006
CN 201136450 Y 10/2008
(Continued)

OTHER PUBLICATIONS http://www.cocopri.jp/article/detail/1803429

*Primary Examiner* — Milton Nelson, Jr.
(74) *Attorney, Agent, or Firm* — Norris McLaughlin & Marcus, P.A.

(57) ABSTRACT

A cushion for a chair including a seat member and a back-supporting member, wherein the seat member includes two ischium-facing portions, a surface of each ischium-facing portion abutting an ischium of the user and having a specific three-dimensional curved surface; and the back-supporting member includes an ilium upper border-facing portion and a lower ribs-facing portion, a surface of the ilium upper border-facing portion abutting an ilium of the user and being entirely concavely curved in a transverse cross section along a left-right direction, a surface of the lower ribs-facing portion abutting the lower ribs of the user and being entirely concavely curved in the transverse cross section along the left-right direction, and a portion of the back-supporting member upper than the lower ribs-facing portion having a specific three-dimensional curved surface.

20 Claims, 7 Drawing Sheets

(56) References Cited

U.S. PATENT DOCUMENTS

| | | | | |
|---|---|---|---|---|
| 7,040,708 | B2 * | 5/2006 | Black | 297/452.34 |
| 7,044,547 | B2 * | 5/2006 | Sorrenti | 297/250.1 |
| 8,566,987 | B1 | 10/2013 | Burge | |
| 8,602,493 | B1 * | 12/2013 | Chen et al. | 297/284.9 |
| 8,881,356 | B2 * | 11/2014 | Geenen et al. | 29/91.1 |
| 2006/0170274 | A1 * | 8/2006 | Moule | 297/452.25 |
| 2011/0272979 | A1 | 11/2011 | Franz et al. | |
| 2012/0049593 | A1 | 3/2012 | Inou et al. | |
| 2013/0043707 | A1 | 2/2013 | Yoon | |
| 2013/0060282 | A1 | 3/2013 | Pham | |
| 2013/0113264 | A1 | 5/2013 | Pham | |
| 2013/0257132 | A1 | 10/2013 | Chen | |

FOREIGN PATENT DOCUMENTS

| | | | |
|---|---|---|---|
| CN | 102860687 | A | 1/2013 |
| DE | 9303674 | U1 | 5/1993 |
| EP | 2095742 | A1 | 9/2009 |
| FR | 2 891 447 | | 4/2007 |
| JP | 11-510712 | A | 9/1999 |
| JP | 2007-125106 | A | 5/2007 |
| JP | 2012-046005 | | 3/2012 |
| JP | 3176305 | | 5/2012 |
| KR | 20-0342238 | | 2/2004 |

* cited by examiner

CUSHION FOR CHAIR AND CHAIR

FIELD OF THE INVENTION

The present invention relates to a cushion for a chair and a chair.

BACKGROUND OF THE INVENTION

Cushions for a chair are used on chairs such as, for example, office chairs. Well-known cushions used on the office chairs and the like include zabutons (i.e., seat cushion) that can be mounted on a seating face of a chair, and backrest cushions that are attached to a backrest member of a chair and abut on the back of a user seated.

However, the zabutons and the backrest cushions tend to result in a situation in which a part of buttocks of the user seated bear the body weight of the user, leading to compression of the buttocks and/or poor posture. In addition, the backrest cushions may bring the user into a feeling of compression of the chest or the abdomen and into difficulty in breathing.

Examples of well-known seat devices having a function of retaining a person's seated position that are principally applied to driver's seats for vehicles include a seat device having a function of retaining a person's seated position as disclosed in Japanese Unexamined Patent Application, Publication No. 2012-46005. The seat device as disclosed in the publication includes, in the vicinity of a position at which an ilium of a user seated is to abut, on the backrest member being to abut on the back of the user seated, a pair of ilium support projections which are fitted to ilium projections of the user. The seat device having a function of retaining a person's seated position prevents, by means of the ilium projections, the person seated while driving from being brought into a submarine state (a state in which the buttocks are moved forward and the pelvis leans rearward), whereby the user seated can easily retain his or her posture, leading to preclusion of occurrence of difficulty in breathing. Although the seat device having a function of retaining a person's seated position can be suitably used principally in the driver's seats for vehicles as mentioned above, the seat device does not always have a structure suitable for chairs such as office chairs.

PRIOR ART DOCUMENTS

Patent Documents

Patent Document 1: Japanese Unexamined Patent Application, Publication No. 2012-46005

SUMMARY OF THE INVENTION

The present invention was made in view of the foregoing circumstances, and an object of the present invention is to provide a cushion for a chair and a chair that are less likely to cause compression of the buttocks of a user seated, and enable the user to maintain his or her posture precisely and easily, whereby occurrence of difficulty in breathing can be avoided.

According to an aspect of the present invention made for achieving the object, a cushion for a chair includes a seat member and a back-supporting member, wherein the seat member is to abut on buttocks of a user seated and includes two ischium-facing portions, a surface of each ischium-facing portion being to abut on an ischium of the user seated, each ischium-facing portion having a three-dimensional curved surface such that the surface of the ischium-facing portion is concavely curved in a vertical cross section along a left-right direction in relation to the user seated with his or her back to face the back-supporting member (hereinafter, may be simply referred to as "left-right direction") and is sloped upward toward a rear side in a vertical cross section along a front-back direction in relation to the user seated with his or her back to face the back-supporting member (hereinafter, may be simply referred to as "front-back direction"), and the back-supporting member is to abut on a back of the user seated and includes an ilium upper border-facing portion and a lower ribs-facing portion, a surface of the ilium upper border-facing portion being to abut on an ilium of the user seated, a surface of the lower ribs-facing portion being to abut on lower ribs of the user seated, the surface of the ilium upper border-facing portion being entirely concavely curved in the transverse cross section along the left-right direction, the surface of the lower ribs-facing portion being entirely concavely curved in the transverse cross section along the left-right direction, and a portion of the back-supporting member upper than the lower ribs-facing portion having a three-dimensional curved surface such that the surface of the portion of the back-supporting member upper than the lower ribs-facing portion is entirely concavely curved in the transverse cross section along the left-right direction and is inclined rearward toward the upper part in a vertical cross section along an up-down direction in relation to the user seated with his or her back to face the back-supporting member (hereinafter, may be simply referred to as "up-down direction").

It is to be noted that the term "chair" as referred to herein broadly means a piece of furniture that includes a seating face and a backrest member and is designed to accommodate one person.

The cushion for a chair according to the aspect of the present invention is used in a state in which the seat member is mounted on a seating face of a chair, and when the user is seated on the cushion for a chair, the ischium of the buttocks of the user seated is likely to be precisely settled in the ischium-facing portion of the seat member, since the ischium-facing portion of the seat member has a three-dimensional curved surface such that the surface of the ischium-facing portion of the seat member is concavely curved in the vertical cross section along the left-right direction and is sloped upward toward the rear side in the vertical cross section along the front-back direction. In addition, the upper border of the ilium and the lower ribs of the user seated are precisely positioned at the ilium upper border-facing portion and the lower ribs-facing portion of the back-supporting member, respectively. Note that: the surface of the ilium upper border-facing portion is entirely concavely curved in the transverse cross section along the left-right direction; the surface of the lower ribs-facing portion is entirely concavely curved in the transverse cross section along the left-right direction; and the portion of the back-supporting member upper than the lower ribs-facing portion has a three-dimensional curved surface such that the surface of the portion of the back-supporting member upper than the lower ribs-facing portion is entirely concavely curved in the transverse cross section along the left-right direction and is inclined rearward toward the upper part in the vertical cross section along the up-down direction. Consequently, the back of the user seated is held in such a manner that the back of the user seated is enfolded and supported from below by the back-supporting member. Thus, according to the cushion for a chair, compression of the buttocks of the user seated is less likely to occur, and the user can maintain his or her posture precisely and easily, whereby difficulty in breathing can be avoided.

In regard to the cushion for a chair, it is preferred that the surface of the ischium-facing portion is sloped upward toward the front side in the vertical cross section along the front-back direction. According to such a configuration, the ischium of the buttocks of the user seated is likely to be settled in the ischium-facing portion more precisely.

In regard to the cushion for a chair, it is preferred that the seat member includes a ridge provided at least from the middle portion thereof toward the front side, and a pair of troughs provided on both sides of the ridge, and that the surface of the ridge and the pair of troughs are continuous in the vertical cross section along the left-right direction. According to such a configuration, a pair of thighs of the user seated are precisely fitted in the pair of troughs and the thighs of the user seated are precisely positioned, whereby the posture of the user seated is likely to be maintained.

It is to be noted that in regard to the cushion for a chair, for example, the seat member and the back-supporting member may be separately produced and individually attached to a chair. However, in regard to the cushion for a chair according to the aspect of the present invention, it is preferred that the seat member and the back-supporting member are integrally formed. According to such a configuration, the cushion for a chair can be easily attached to the chair, and when attached, each portion is likely to be positioned accurately.

The cushion for a chair preferably has a three-dimensional curved surface such that the surface of a rear portion of the seat member extending from the ischium-facing portion to the back-supporting member is concavely curved in the vertical cross section along the left-right direction, and is continuous from the ischium-facing portion to the back-supporting member in the vertical cross section along the front-back direction. According to such a configuration, the buttocks of the user can be held in such a manner that the buttocks posterior to the ischium are enfolded by the rear portion of the seat member, whereby the posture of the user seated is likely to be precisely maintained.

In regard to the cushion for a chair, a portion of the back-supporting member lower than the ilium upper border-facing position preferably has a three-dimensional curved surface such that the surface of the portion lower than the ilium upper border-facing position is concavely curved in the transverse cross section along the left-right direction and is continuous to the rear portion of the seat member in the vertical cross section along the front-back direction. According to such a configuration, the buttocks of the user can be held in such a manner that the posterior buttocks are enfolded by the lower portion of the back-supporting member, whereby the posture of the user seated is likely to be precisely maintained.

In regard to the cushion for a chair, an angle between the seat member and the back-supporting member in the side view is preferably no less than 90° and no greater than 110°. According to such a configuration, the cushion for a chair can be easily and certainly mounted on a chair such as an office chair.

According to another aspect of the present invention made for achieving the object, a chair includes a seat member and a back-supporting member, wherein the seat member is to abut on buttocks of a user seated and includes two ischium-facing portions, a surface of each ischium-facing portion being to abut on an ischium of the user seated, each ischium-facing portion having a three-dimensional curved surface such that the surface of the ischium-facing portion is concavely curved in a vertical cross section along a left-right direction and is sloped upward toward a rear side in a vertical cross section along a front-back direction, and the back-supporting member is to abut on a back of the user seated and includes an ilium upper border-facing portion and a lower ribs-facing portion, a surface of the ilium upper border-facing portion being to abut on an ilium of the user seated, a surface of the lower ribs-facing portion being to abut on lower ribs of the user seated, the surface of the ilium upper border-facing portion being entirely concavely curved in the transverse cross section along the left-right direction, the surface of the lower ribs-facing portion being entirely concavely curved in the transverse cross section along the left-right direction, and a portion of the back-supporting member upper than the lower ribs-facing portion having a three-dimensional curved surface such that the surface of the portion of the back-supporting member upper than the lower ribs-facing portion is entirely concavely curved in the transverse cross section along the left-right direction and is inclined rearward toward the upper part in a vertical cross section along an up-down direction.

When the user is seated on the chair, the ischium of the buttocks of the user seated is likely to be precisely settled in the ischium-facing portion of the seat member, since the ischium-facing portion of the seat member has a three-dimensional curved surface such that the surface of the ischium-facing portion of the seat member is concavely curved in the vertical cross section along the left-right direction and is sloped upward toward the rear side in the vertical cross section along the front-back direction. In addition, the upper border of the ilium and the lower ribs of the user seated are precisely positioned at the ilium upper border-facing portion and the lower ribs-facing portion of the back-supporting member, respectively. Note that: the surface of the ilium upper border-facing portion is entirely concavely curved in the transverse cross section along the left-right direction; the surface of the lower ribs-facing portion is entirely concavely curved in the transverse cross section along the left-right direction; and the portion of the back-supporting member upper than the lower ribs-facing portion has a three-dimensional curved surface such that the surface of the portion of the back-supporting member upper than the lower ribs-facing portion is entirely concavely curved in the transverse cross section along the left-right direction and is inclined rearward toward the upper part in the vertical cross section along the up-down direction. Consequently, the back of the user seated is held in such a manner that the back of the user seated is enfolded and supported from below by the back-supporting member. Thus, the chair is less likely to cause compression of the buttocks of the user seated, and enables the user to maintain his or her posture precisely, whereby difficulty in breathing can be avoided.

As explained in the foregoing, the cushion for a chair and the chair according to the aspects of the present invention are less likely to cause compression of the buttocks of the user seated, and enable the user to maintain his or her posture precisely and easily, whereby difficulty in breathing can be avoided.

DESCRIPTION OF THE PREFERRED EMBODIMENTS

Before explaining the present invention in detail, it is to be understood that the present invention is not limited to the particular embodiments and that it can be practiced or carried out in various ways.

A cushion for a chair will be explained as an embodiment of the present invention. The cushion for a chair according to the embodiment can be suitably used on a chair that includes a seating face and a backrest member.

Figure 1:
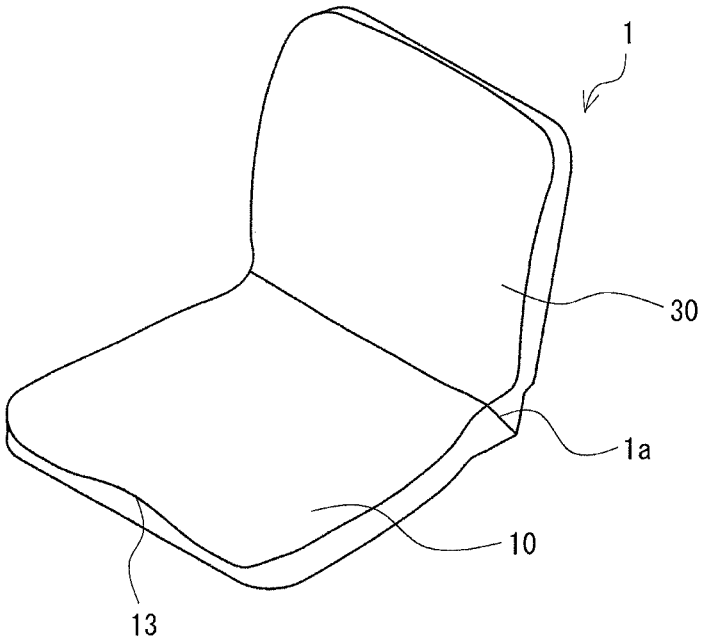
FIG. 1 is a schematic perspective view of the cushion for a chair according to an embodiment of the present invention.

The cushion for a chair includes a cushion main body 1 and a case that covers the cushion main body 1 (not shown in the figure). As shown in FIG. 1, the cushion main body 1 includes a seat member 10 that is to be mounted on a seating face of a chair and is to abut on the buttocks of a user seated, and a back-supporting member 30 that is to abut on the back of the user seated. The seat member 10 and the back-supporting member 30 are integrally formed. The cushion main body 1 is made of a resilient (shock-absorbing) member, and more specifically, a foamed resin such as a urethane foam. Since the cushion main body 1 is made of a resilient member, an angle α between the seat member 10 and the back-supporting member 30, which are integrally formed as described above, in the side view is variable. When the cushion for a chair is configured as mentioned above, the cushion main body 1 is deformed in harmony with an angle between a seating face and a backrest member of a chair, and therefore the cushion for a chair is precisely mounted on the chair.

The cushion main body 1 includes, in a portion where the seat member 10 and the back-supporting member 30 are consecutively connected, a necking 1*a* in which a width along the left-right direction is decreased. Therefore, the cushion main body 1 can be easily deformed in the direction along which an angle α between the seat member 10 and the back-supporting member 30 is changed.

It is also possible that the seat member 10 and the back-supporting member 30 are separately formed and are subsequently joined to form the cushion main body 1. However, the back-supporting member 30 and the seat member 10 are preferably formed by integral molding.

A width W1 along the left-right direction of the seat member 10 is 430 mm, and the width W1 of the seat member 10 is preferably no less than 300 mm and no greater than 550 mm. The lower limit of the width W1 is more preferably 350 mm, and still more preferably 400 mm. The upper limit of the width W1 is more preferably no greater than 500 mm, and still more preferably 450 mm.

A width L1 along the front-back direction of the seat member 10 is 414 mm, and the width L1 of the seat member 10 is preferably no less than 300 mm and no greater than 550 mm. The lower limit of the width L1 is more preferably 350 mm, and still more preferably 400 mm. The upper limit of the width L1 is more preferably 500 mm, and still more preferably 450 mm.

A height H1 of the back-supporting member 30 (a height from the bottom face of the seat member 10) is 366 mm, and the height H1 of the back-supporting member 30 is preferably no less than 280 mm and no greater than 500 mm. The lower limit of the height H1 is more preferably 300 mm, and still more preferably 340 mm. The upper limit of the height H1 is more preferably 450 mm, and still more preferably no greater than 400 mm.

When the width W1 and the width L1 of the seat member 10 as well as the height H1 of the back-supporting member 30 fall within the above ranges, respectively, the cushion for a chair can be suitably attached to chairs for adults.

In the case of a cushion for children, the width W1 and the width L1 of the seat member 10 as well as the height H1 of the back-supporting member 30 preferably fall within the following ranges, respectively.

The width W1 of the seat member 10 is preferably no less than 200 mm and no greater than 450 mm. The lower limit of the width W1 is more preferably 250 mm, and still more preferably 300 mm. The upper limit of the width W1 is more preferably 400 mm, and still more preferably 350 mm.

The width L1 of the seat member 10 is preferably no less than 200 mm and no greater than 450 mm. The lower limit of the width L1 is more preferably 250 mm, and still more preferably 300 mm. The upper limit of the width L1 is more preferably 400 mm, and still more preferably 350 mm.

The height H1 of the back-supporting member 30 is preferably no less than 180 mm and no greater than 400 mm. The lower limit of the height H1 is more preferably 200 mm, and still more preferably 240 mm. The upper limit of the height H1 is more preferably 350 mm, and still more preferably no greater than 300 mm.

The bottom face (back face) of the seat member 10 is flat. A rear face (back face) of the back-supporting member 30 is flat. Thus, when the cushion main body 1 is mounted on a chair, the bottom face of the seat member 10 is precisely mounted on a seating face of the chair in a state in which the rear face of the back-supporting member 30 abuts on a backrest member of the chair.

The angle α between the seat member 10 and the back-supporting member 30 in the side view is preferably no less than 90° and no greater than 110°, and more preferably no less than 100° and no greater than 105°. When the angle α falls within the above range, the cushion main body 1 can be readily mounted precisely on an office chair. In the case of a cushion for children, the angle α is preferably about 90° (90°±5°. It is to be noted that the angle α between the seat member 10 and the back-supporting member 30 in the side view as referred to herein means an angle in a normal state with no external force applied to the cushion main body 1.

The seat member 10 and the back-supporting member 30 each have a three-dimensionally curved surface. In the following, the shape of the surfaces of the seat member 10 and the back-supporting member 30 is described in more detail.

Figure 3:
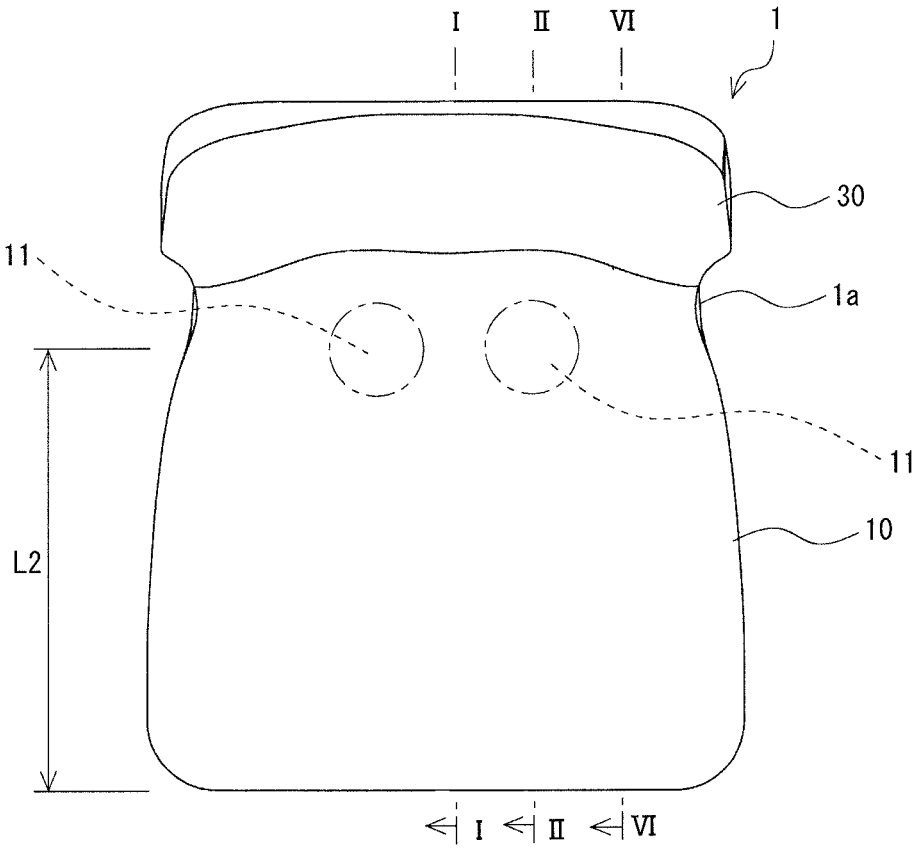
FIG. 3 is a schematic plan view of the cushion for a chair shown in FIG. 1.
Figure 4:
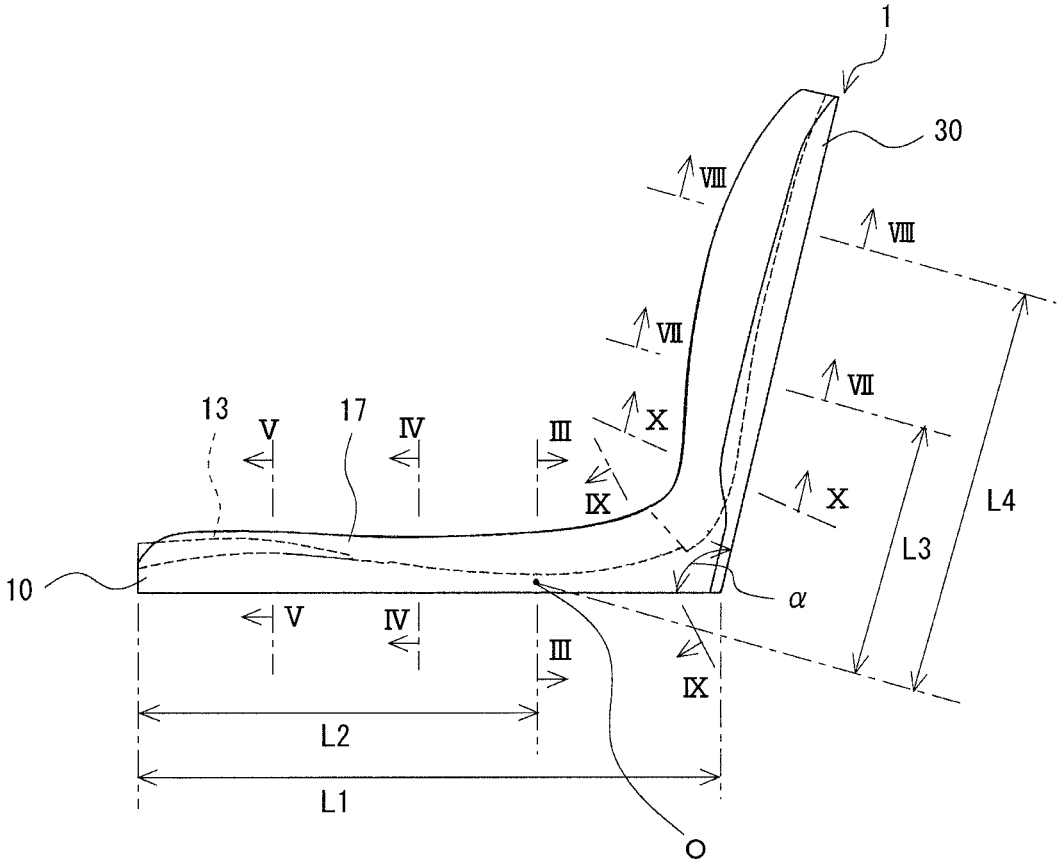
FIG. 4 is a schematic side view of the cushion for a chair shown in FIG. 1.
Figure 5:
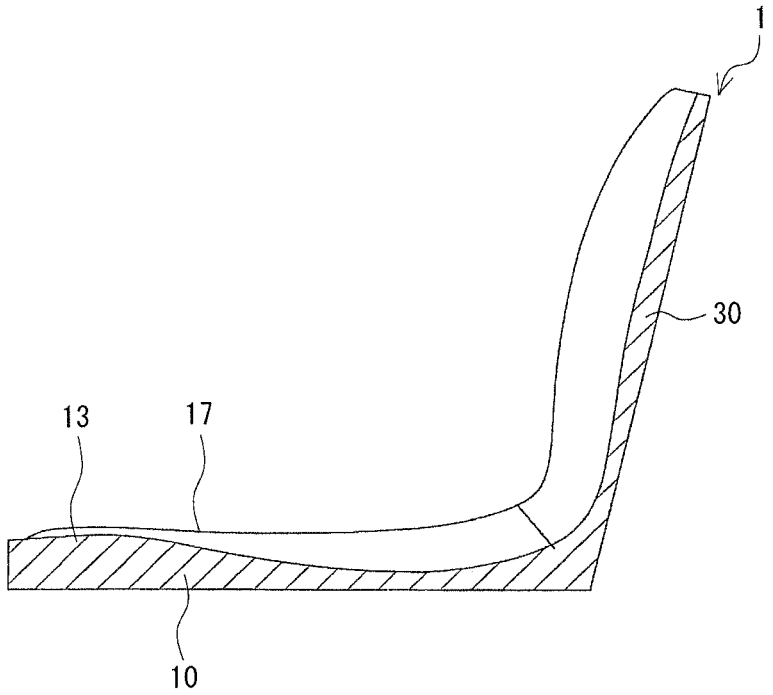
FIG. 5 is a cross sectional view taken along the line I-I in FIG. 3.

The seat member 10 includes two ischium-facing portions 11 that have a recessed surface, and the surface of the ischium-facing portion 11 is concavely curved. The ischium-facing portion 11 has a three-dimensional curved surface such that the surface of the ischium-facing portion 11 is concavely curved in the vertical cross section along the left-right direction and is sloped upward toward the front and rear sides in the vertical cross section along the front-back direction. The ischium-facing portion 11 as referred to herein means a portion that is to abut on the ischium of the user seated, and more specifically, a vicinity of the lowest point O (the point nearest to the back face of the seat member 10) in the surface of the seat member 10 being to abut on the buttocks of the user seated (a region within 80 mm from the lowest point (i.e., a region encircled by a dashed line in FIG. 3)).

In the present embodiment, a distance W2 between the respective centers O of the two ischium-facing portions 11 is 108 mm. The distance W2 between the respective centers O of the two ischium-facing portions 11 is preferably no less than 70 mm and no greater than 130 mm. The lower limit of the distance W2 between the centers O is more preferably 90 mm, and the upper limit of the distance W2 between the centers O is more preferably 120 mm. When the distance W2 between the centers O falls within the above range, in the case of a user seated being an adult, an ischium of the user seated is settled in the ischium-facing portion 11.

In the case of a cushion for children, the distance W2 between the respective centers O of the two ischium-facing portions 11 is preferably no less than 70 mm and no greater than 120 mm. The lower limit of the distance W2 between the centers O is more preferably 80 mm, and the upper limit of the distance W2 between the centers O is more preferably 110 mm.

It is to be noted that in the present embodiment, a thickness H2 of the seat member 10 in the center O of the ischium-facing portion 11 (a distance between the center O of the ischium-facing portion 11 and the bottom face) is 9 mm.

In the present embodiment, a distance L2 from the center O of the ischium-facing portion 11 to a front edge of the cushion main body 1 is 314 mm. The distance L2 from the center O of the ischium-facing portion 11 to the front edge of the cushion main body 1 is preferably no less than 280 mm and no greater than 400 mm. The lower limit of the distance L2 is more preferably 300 mm, and the upper limit of the distance L2 is more preferably 350 mm.

In the case of a cushion for children, the distance L2 from the center O of the ischium-facing portion 11 to the front edge of the cushion main body 1 is preferably no less than 230 mm and no greater than 350 mm. The lower limit of the distance L2 is more preferably 250 mm, and the upper limit of the distance L2 is more preferably 300 mm.

Figure 6:
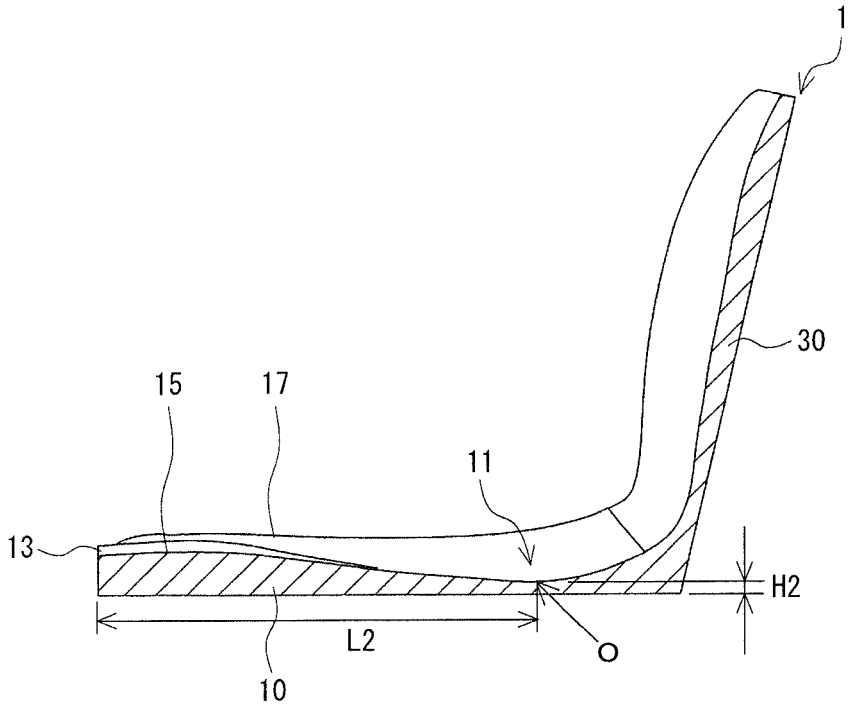
FIG. 6 is a cross sectional view taken along the line II-II in FIG. 3.

In the vertical cross section along the front-back direction of the ischium-facing portion 11, the surface of the ischium-facing portion 11 is sloped more steeply upward on the rear side of the center O of the ischium-facing portion 11 than on the front side thereof (see FIG. 6).

Figure 7:
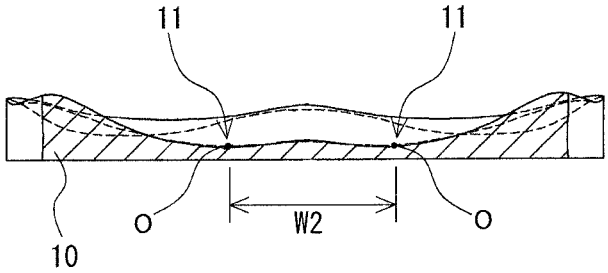
FIG. 7 is a cross sectional view taken along the line III-III in FIG. 4.
Figure 8:
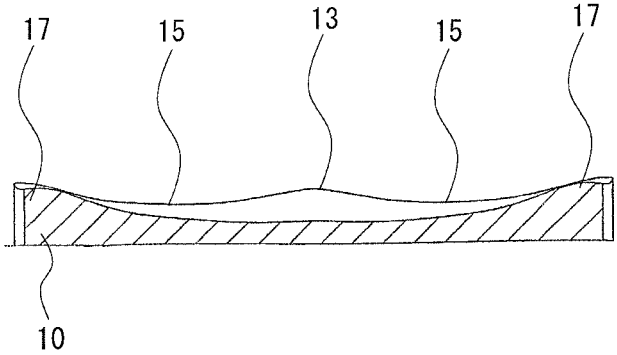
FIG. 8 is a cross sectional view taken along the line IV-IV in FIG. 4.

Since the surface of the pair of ischium-facing portions 11 of the seat member 10 is concavely curved as mentioned above, the seat member 10 includes, between the ischium-facing portions 11 that are positioned on the rear side along the front-back direction (in the middle between the ischium-facing portions 11 along the left-right direction), an elevated portion relative to the ischium-facing portion 11 (see FIG. 7), and the surface in the middle of the seat member 10 along the front-back direction is entirely concavely curved in the vertical cross section along the left-right direction (see FIG. 8).

The seat member 10 includes a ridge 13 provided from the middle portion thereof toward the front side along the front-back direction, and a pair of troughs 15 provided on both sides of the ridge 13. The surface of the ridge 13 and the pair of troughs 15 are continuous in the cross section along the left-right direction (see FIG. 9). The pair of troughs 15 are arranged so that the respective ischium-facing portions 11 are positioned on an imaginary extended line toward the rear side.

Figure 2:
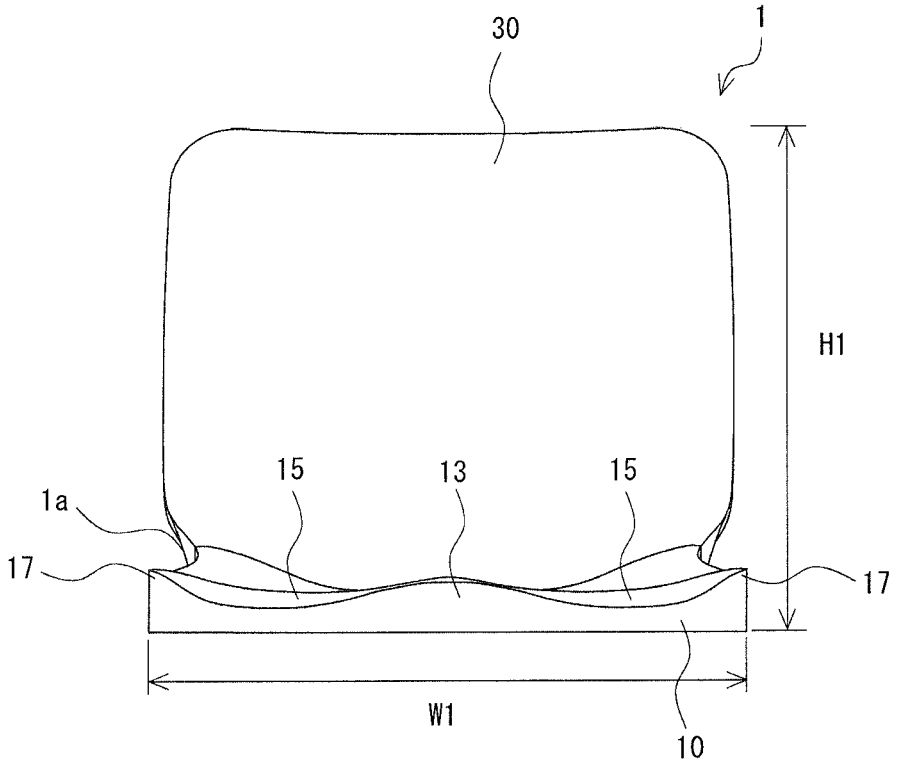
FIG. 2 is a schematic front view of the cushion for a chair shown in FIG. 1.

The surface of the trough 15 is sloped so that a distance between the lowest points of the troughs 15 in the vertical cross section along the left-right direction increases from the rear side to the front side (see FIG. 2). Thus, the lowest point of the front edge of the trough 15 is positioned on an outer side than the position of the ischium-facing portion 11 along the left-right direction. The surface of the trough 15 is sloped upward from the ischium-facing portion 11 toward the front side, and thereafter is sloped downward toward the front side (see FIG. 10). Therefore, even in a state in which the ischium is settled in the ischium-facing portion 11 as mentioned above, the user seated can move his or her legs easily when the user seated intends to do so.

Figure 9:
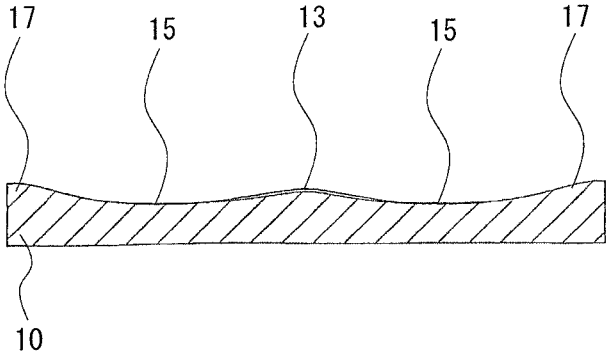
FIG. 9 is a cross sectional view taken along the line V-V in FIG. 4.

The seat member 10 includes, on the left and right edges (outside the trough 15), outer ridges 17 that are raised relative to other portions (for example, ridge 13) (see FIGS. 7 to 9). This configuration allows an outward spread of the user's legs to be minimized.

In the cross section along the left-right direction of the back-supporting member 30, the back-supporting member 30 is concavely curved in the ilium upper border-facing portion and the lower ribs-facing portion.

Figure 11:
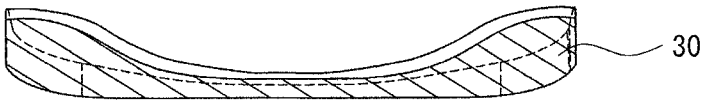
FIG. 11 is a cross sectional view taken along the line VII-VII in FIG. 4.

The ilium upper border-facing portion as referred to herein means a portion that is to abut on the upper border of the ilium of the user seated. In the present embodiment, the ilium upper border-facing portion means a position away from the center) of the ischium-facing portion 11 by a distance of 150 mm (L3) in the direction along which the back-supporting member 30 extends (i.e., a position at which the cross section shown in FIG. 11 is taken).

The distance L3 from the center O of the ischium-facing portion 11 to the center of the ilium upper border-facing portion in the direction along which the back-supporting member 30 extends is preferably no less than 120 mm and no greater than 180 mm. The lower limit of the distance L3 is preferably 140 mm, and the upper limit of the distance L3 is preferably 160 mm.

In the case of a cushion for children, the distance L3 from the center O of the ischium-facing portion 11 to the center of the ilium upper border-facing portion is preferably no less than 80 mm and no greater than 120 mm. The lower limit of the distance L3 is more preferably 90 mm, and the upper limit of the distance L3 is more preferably 110 mm.

Figure 12:
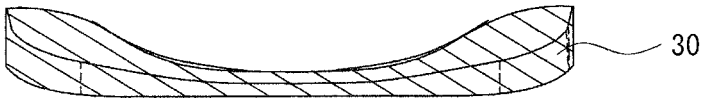
FIG. 12 is a cross sectional view taken along the line VIII-VIII in FIG. 4.
Figure 13:
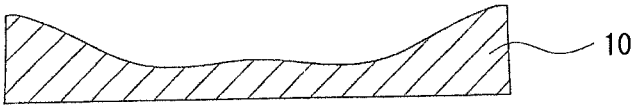
FIG. 13 is a cross sectional view taken along the line IX-IX in FIG. 4.
Figure 14:
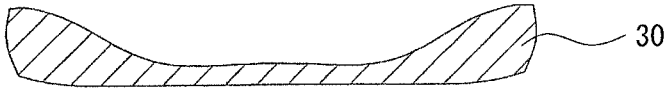
FIG. 14 is a cross sectional view taken along the line X-X in FIG. 4.

The lower ribs-facing portion as referred to means a portion that is to abut on the lower ribs of the user seated. More specifically, in the present embodiment, the lower ribs-facing portion means a position away from the center O of the ischium-facing portion 11 by a distance (L4) of 250 mm in the direction along which the back-supporting member 30 extends (i.e., a position at which the cross section shown in FIG. 12 is taken). It is to be noted that the distance L4 from the center O of the ischium-facing portion 11 to the lower ribs-facing portion in the direction along which the back-supporting member 30 extends is preferably no less than 220 mm and no greater than 280 mm. The lower limit of the distance L4 is preferably 240 mm, and the upper limit of the distance L3 is preferably 260 mm.

In the case of a cushion for children, the distance L4 from the center O of the ischium-facing portion 11 to the lower ribs-facing portion is preferably no less than 180 mm and no greater than 240 mm. The lower limit of the distance L4 is preferably 200 mm, and the upper limit of the distance L4 is more preferably 220 mm.

Figure 10:
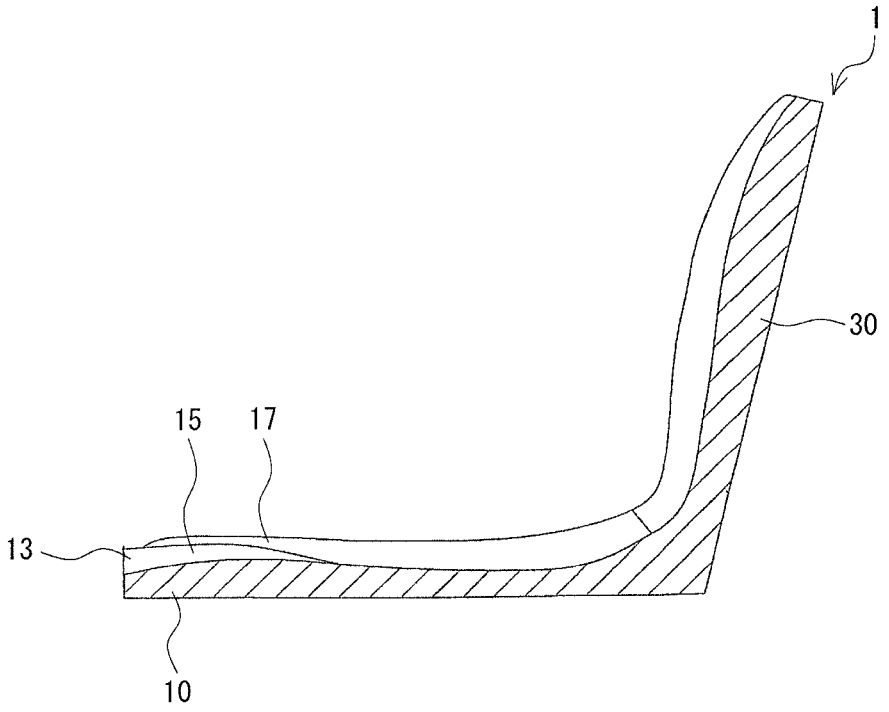
FIG. 10 is a cross sectional view taken along the line VI-VI in FIG. 3.

The surface of the portion of the seat member 10 upper than the lower ribs-facing portion (hereinafter, may be also referred to as "upper portion") is entirely concavely curved in the transverse cross section along the left-right direction and is declined rearward toward the upper part in the vertical cross section along the up-down direction (see FIG. 10). According to such a configuration, the upper portion has a three-dimensional curved surface. The three-dimensional curved surface of the upper portion is such that a radius of curvature of the concave surface of the upper portion is larger than that of the concave surface of the lower ribs-facing portion.

The surface of the seat member 10 and the back-supporting member 30 is a continuous three-dimensional curved surface such that the surface from the ischium-facing portion 11 to the ilium upper border-facing portion is entirely concaved.

The rear portion of the seat member 10 from the ischium-facing portion 11 to the back-supporting member 30 (toward the back side) has a three-dimensional curved surface such that the surface of the rear portion of the seat member 10 from the ischium-facing portion 11 to the back-supporting member 30 is concavely curved in the vertical cross section along the left-right direction and is continuous from the ischium-facing portion 11 to the back-supporting member 30 in the vertical cross section along the up-down direction.

A portion of the back-supporting member 30 lower than the ilium upper border-facing position (hereinafter, may be also referred to as "lower portion") has a three-dimensional curved surface such that the surface of the lower portion is concavely curved in the transverse cross section along the left-right direction and is continuous with the rear portion of the seat member 10 in the vertical cross section along the up-down direction.

The cushion for a chair according to the embodiment as configured as above is used in a state in which the seat member 10 is mounted on a seating face of a chair. When a user is seated on the cushion for a chair, the ischium of the buttocks of the user seated is likely to be precisely settled in the ischium-facing portion 11 of the seat member 10, leading to less compression of the buttocks of the user seated and the stabilization of the posture of the user seated, since the seat member 10 has the three-dimensional curved surface. In addition, the buttocks of the user seated are less likely to be moved forward. In particular, since the ischium-facing portion 11 in the embodiment has such a surface shape that is sloped upward toward the front side, the forward movement of the buttocks of the user seated can be inhibited more effectively.

When the ischium of the user seated is settled in the ischium-facing portion 11 in such a manner, the upper border of the ilium and the lower ribs of the user seated are precisely positioned at the ilium upper border-facing portion and the lower ribs-facing portion, respectively. Since the surface of the ilium upper border-facing portion and the lower ribs-facing portion is concavely curved in the transverse cross section along the left-right direction, and the surface of the upper portion has a three-dimensional curved surface such that the upper portion is inclined rearward toward the upper part in the vertical cross section along the up-down direction, the back of the user seated is held in such a manner that the back of the user is enfolded and supported from below by the back-supporting member 30. In particular, the back of the user seated is supported such that the ribs of the user seated are lifted upward by virtue of the surface shape of the portion upper than the lower ribs-facing portion, resulting in less feeling of compression of the chest and the like, thereby precluding possible difficulty in breathing in the user seated. In addition, the user seated can easily hold a posture with his or her head higher to have such a wider view as to help grasp the surrounding situation and communicate with others therearound. Moreover, when the posture of the user seated is held as mentioned above, the user seated can relax his or her shoulder and easily raise his or her arms, leading to ease of using both hands. Furthermore, the user can sit in a comfortable posture, as mentioned above, whereby the user can start a motion such as standing up, and for example, when the cushion for a chair according to the embodiment of the present invention is used on an office chair, the user can work smoothly during execution of a job such as an office work while maintaining his or her posture.

It is to be noted that although the embodiment described above provides the aforementioned advantages based on the configuration explained above, the embodiment may be modified appropriately within the scope of the gist of the present invention.

More specifically, although in the embodiment described above, a cushion for a chair suitably used principally for office chairs has been explained by way of example, the present invention is not limited thereto. The cushion for a chair according to the embodiment may be appropriately modified so as to be used for a chair for schoolchildren used in, for example, schools and the like.

Although in the embodiment described above, a cushion for a chair having the cushion main body 1 covered with a case is explained by way of example, the case is not an essential constituent feature of the present invention. Even when the case is used, for example, the case may be provided with a member for attachment to a chair. Specifically, examples of the member for attachment include a string-like member for being wound around a chair, and a fabric member that is sewn on the rear face side of the back-supporting member 30 to form a bag for enveloping the backrest member, and the like.

Even when the cushion for a chair according to the embodiment of the present invention includes the case and the cushion main body as mentioned above, the material for making the cushion main body is not limited to a urethane foam, and obviously, various well-known materials may be adopted.

Although in the above embodiment, a cushion for a chair has been explained as an exemplary embodiment of the present invention, a configuration similar to the embodiment described above may be applied to a chair. In other words, the present invention also encompasses a chair, and a chair that includes a seat member and a back-supporting member each having a special surface shape as explained in the aforementioned embodiment is also contemplated within the scope of the present invention. Also, in the chair according to an embodiment of the present invention, it is evident that the aforementioned advantages can be exerted by employing a configuration similar to the above embodiment (including an ischium-facing portion, an ilium upper border-facing portion, a lower ribs-facing portion, an upper portion, a ridge, a trough, and the like). In addition, it is also obvious that well-known various materials can be used as a material for making the chair according to the embodiment of the present invention.

As explained in the foregoing, the cushion for a chair and the chair according to the aspects of the present invention are less likely to cause compression of the buttocks of the user seated, and enable the user to maintain his or her posture precisely, whereby difficulty in breathing can be avoided.

As described above, since the cushion for a chair and the chair according to the present invention facilitate maintenance of a user's proper posture, the cushion for a chair and the chair can be suitably used for office chairs, chairs for studying, living chairs, etc., as mentioned above, as well as seats, and the like.

EXPLANATION OF THE REFERENCE SYMBOLS

1: cushion main body
1*a*: necking
10: seat member
11: ischium-facing portion
13: ridge
15: trough
17: outer ridge
30: back-supporting member
O: point
α: angle

What is claimed is:

1. A cushion for a chair comprising a seat member and a back-supporting member, wherein the seat member is configured to abut on buttocks of a user seated and comprises two ischium-facing portions, a surface of each ischium-facing portion is configured to abut on an ischium of the user seated, each ischium-facing portion has a three-dimensional curved surface such that the surface of the ischium-facing portion is concavely curved in a vertical cross section along a left-right direction and is sloped upward toward a rear side in a vertical cross section along a front-back direction, the back-supporting member is configured to abut on a back of the user seated and comprises an ilium upper border-facing portion and a lower ribs-facing portion, a surface of the ilium upper border-facing portion is configured to abut on an ilium of the user seated, a surface of the lower ribs-facing portion is configured to abut on lower ribs of the user seated, the surface of the ilium upper border-facing portion is located no less than 120 mm and no greater than 180 mm away from a first plane which intersects one of the centers of the ischium-facing portions and which is perpendicular to a direction defined by a height of the back-supporting member, and the surface of the ilium upper border-facing portion is entirely concavely curved in the transverse cross section along the left-right direction, the surface of the lower ribs-facing portion is located no less than 220 mm and no greater than 280 mm away from the first plane and is entirely concavely curved in the transverse cross section along the left-right direction, and a portion of the back-supporting member higher than the lower ribs-facing portion has a three-dimensional curved surface which is entirely concavely curved in the transverse cross section along the left-right direction and is inclined rearward toward an upper part in a vertical cross section along an up-down direction, the back-supporting member has a continuous three-dimensional curved surface which is totally concave from the ilium upper border-facing portion to the lower ribs-facing portion, and a radius of curvature of the three-dimensional curved surface of the portion of the back-supporting member above the lower ribs-facing portion along the left-right direction is larger than a radius of curvature of the surface of the lower ribs-facing portion along the left direction.

2. The cushion for a chair according to claim 1, wherein the surface of the ischium-facing portion is sloped upward toward the front side in the vertical cross section along the front-back direction.

3. The cushion for a chair according to claim 1, wherein the seat member comprises a ridge provided at least in front of a middle portion thereof, and a pair of troughs provided on both sides of the ridge, and the surface of the ridge and the pair of troughs being continuous in the vertical cross section along the left-right direction.

4. The cushion for a chair according to claim 1, wherein the seat member and the back-supporting member are integrally formed.

5. The cushion for a chair according to claim 4, wherein the cushion for a chair has a three-dimensional curved surface at a rear portion of the seat member extending from the ischium-facing portion to the back-supporting member which is concavely curved in the vertical cross section along the left-right direction, and is continuous from the ischium-facing portion to the back-supporting member in the vertical cross section along the front-back direction.

6. The cushion for a chair according to claim 4, wherein a portion of the back-supporting member lower than the ilium upper border-facing position has a three-dimensional curved surface which is concavely curved in the transverse cross section along the left-right direction and is continuous to the rear portion of the seat member in the vertical cross section along the front-back direction.

7. The cushion for a chair according to claim 4, wherein an angle defined by the seat member and the back-supporting member is no less than 90° and no greater than 110°.

8. The cushion for a chair according to claim 1, further comprising a necking which connects the seat member and the back-supporting member, wherein a length of the necking is less than a width of the seat member and a width of the back-supporting member.

9. A cushion for a chair for children comprising a seat member and a back-supporting member, wherein the seat member is configured to abut on buttocks of a user seated and comprises two ischium-facing portions, a surface of each ischium-facing portion is configured to abut on an ischium of the user seated, each ischium-facing portion has a three-dimensional curved surface such that the surface of the ischium-facing portion is concavely curved in a vertical cross section along a left-right direction and is sloped upward toward a rear side in a vertical cross section along a front-back direction, and the back-supporting member is configured to abut on a back of the user seated and comprises an ilium upper border-facing portion and a lower ribs-facing portion, a surface of the ilium upper border-facing portion is configured to abut on an ilium of the user seated, a surface of the lower ribs-facing portion is configured to abut on lower ribs of the user seated, the surface of the ilium upper border-facing portion is located no less than 80 mm and no greater than 120 mm away from a first plane which intersects one of the centers of the ischium-facing portions and which is perpendicular to a direction defined by a height of the back-supporting member, and the surface of the ilium upper border-facing portion is entirely concavely curved in the transverse cross section along the left-right direction, the surface of the lower ribs-facing portion is located no less than 180 mm and no greater than 240 mm away from the first plane and is entirely concavely curved in the transverse cross section along the left-right direction, and a portion of the back-supporting member higher than the lower ribs-facing portion has a three-dimensional curved surface which is entirely concavely curved in the transverse cross section along the left-right direction and is inclined rearward toward an upper part in a vertical cross section along an up-down direction, the back-supporting member has a continuous three-dimensional curved surface which is totally concave from the ilium upper border-facing portion to the lower ribs-facing portion, and a radius of curvature of the three-dimensional curved surface of the portion of the back-supporting member above the lower ribs-facing portion along the left-right direction is larger than a radius of curvature of the surface of the lower ribs-facing portion along the left right direction.

10. The cushion for a chair according to claim 9, wherein the surface of the ischium-facing portion is sloped upward toward the front side in the vertical cross section along the front-back direction.

11. The cushion for a chair according to claim 9, wherein the seat member comprises a ridge provided at least in front of a middle portion thereof, and a pair of troughs provided on both sides of the ridge, and the surface of the ridge and the pair of troughs being continuous in the vertical cross section along the left-right direction.

12. The cushion for a chair according to claim 9, wherein the seat member and the back-supporting member are integrally formed.

13. The cushion for a chair according to claim 12, wherein the cushion for a chair has a three-dimensional curved surface at a rear portion of the seat member extending from the ischium-facing portion to the back-supporting member which is concavely curved in the vertical cross section along the left-right direction, and is continuous from the ischium-facing portion to the back-supporting member in the vertical cross section along the front-back direction.

14. The cushion for a chair according to claim 12, wherein a portion of the back-supporting member lower than the ilium upper border-facing position has a three-dimensional curved surface which is concavely curved in the transverse cross section along the left-right direction and is continuous to the rear portion of the seat member in the vertical cross section along the front-back direction.

15. The cushion for a chair according to claim 12, wherein an angle defined by the seat member and back-supporting member is no less than 90' and no greater than 110°.

16. The cushion for a chair according to claim 9, further comprising a necking which connects the seat member and the back-supporting member, wherein a length of the necking is less than a width of the seat member and a width of the back-supporting member.

17. A chair comprising a seat member and a back-supporting member, wherein the seat member is configured to abut on buttocks of a user seated and comprises two ischium-facing portions, a surface of each ischium-facing portion is configured to abut on an ischium of the user seated, each ischium-facing portion has a three-dimensional curved surface such that the surface of the ischium-facing portion is concavely curved in a vertical cross section along a left-right direction and is sloped upward toward a rear side in a vertical cross section along a front-back direction, and the back-supporting member is configured to abut on a back of the user seated and comprises an ilium upper border-facing portion and a lower ribs-facing portion, a surface of the ilium upper border-facing portion is configured to abut on an ilium of the user seated, a surface of the lower ribs-facing portion is configured to abut on lower ribs of the user seated, the surface of the ilium upper border-facing portion is located no less than 120 mm and no greater than 180 mm away from a first plane which intersects one of the centers of the ischium-facing portions and which is perpendicular to a direction defined by a height of the back-supporting member, and the surface of the ilium upper border-facing portion is entirely concavely curved in the transverse cross section along the left-right direction, the surface of the lower ribs-facing portion is located no less than 220 mm and no greater than 280 mm away from the first plane and is entirely concavely curved in the transverse cross section along the left-right direction, and a portion of the back-supporting member higher than the lower ribs-facing portion has a three-dimensional curved surface which is entirely concavely curved in the transverse cross section along the left-right direction and is inclined rearward toward an upper part in a vertical cross section along an up-down direction, the back-supporting member has a continuous three-dimensional curved surface which is totally concave from the ilium upper border-facing portion to the lower ribs-facing portion, and a radius of curvature of the three-dimensional curved surface of the portion of the back-supporting member above the lower ribs-facing portion along the left-right direction is larger than a radius of curvature of the surface of the lower ribs-facing portion along the left-right direction.

18. The chair according to claim 17, further comprising a necking which connects the seat member and the back-supporting member, wherein a length of the necking is less than a width of the seat member and a width of the back-supporting member.

19. A chair comprising a seat member and a back-supporting member, wherein the seat member is configured to abut on buttocks of a user seated and comprises two ischium-facing portions, a surface of each ischium-facing portion is configured to abut on an ischium of the user seated, each ischium-facing portion has a three-dimensional curved surface such that the surface of the ischium-facing portion is concavely curved in a vertical cross section along a left-right direction and is sloped upward toward a rear side in a vertical cross section along a front-back direction, and the back-supporting member is configured to abut on a back of the user seated and comprises an ilium upper border-facing portion and a lower ribs-facing portion, a surface of the ilium upper border-facing portion is configured to abut on an ilium of the user seated, a surface of the lower ribs-facing portion is configured to abut on lower ribs of the user seated, the surface of the ilium upper border-facing portion is located no less than 80 mm and no greater than 120 mm away from a first plane which intersects one of the centers of the ischium-facing portions and which is perpendicular to a direction defined by a height of the back-supporting member, and the surface of the ilium upper border-facing portion is entirely concavely curved in the transverse cross section along the left-right direction, the surface of the lower ribs-facing portion is located no less than 180 mm and no greater than 240 mm away from the first plane and is entirely concavely curved in the transverse cross section along the left-right direction, and a portion of the back-supporting member higher than the lower ribs-facing portion has a three-dimensional curved surface which is entirely concavely curved in the transverse cross section along the left-right direction and is inclined rearward toward an upper part in a vertical cross section along an up-down direction, the back-supporting member has a continuous three-dimensional curved surface which is totally concave from the ilium upper border-facing portion to the lower ribs-facing portion, and a radius of curvature of the three-dimensional curved surface of the portion of the back-supporting member above the lower ribs-facing portion along the left-right direction is larger than a radius of curvature of the surface of the lower ribs-facing portion along the left right direction.

20. The chair according to claim 19, further comprising a necking which connects the seat member and the back-supporting member, wherein a length of the necking is less than a width of the seat member and a width of the back-supporting member.

* * * * *